US011549789B2

(12) United States Patent
Taylor et al.

(10) Patent No.: US 11,549,789 B2
(45) **Date of Patent: *Jan. 10, 2023**

(54) OPTIMIZED SUBSONIC PROJECTILES

(71) Applicant: The United States of America, as represented by the Secretary of the Navy, Crane, IN (US)

(72) Inventors: Lucius A. Taylor, Crane, IN (US); Joseph T. Burkart, Bloomfield, IN (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/433,821

(22) Filed: Jun. 6, 2019

(65) Prior Publication Data

US 2019/0323805 A1 Oct. 24, 2019

Related U.S. Application Data

(63) Continuation of application No. 14/953,315, filed on Nov. 28, 2015, now Pat. No. 10,317,178.

(Continued)

(51) Int. Cl.

| | |
|---|---|
| ***F42B 5/02*** | (2006.01) |
| ***F42B 33/00*** | (2006.01) |
| ***F42B 10/24*** | (2006.01) |
| ***F42B 10/00*** | (2006.01) |
| ***F42B 10/32*** | (2006.01) |
| ***F42B 10/44*** | (2006.01) |
| ***F42B 10/38*** | (2006.01) |

(Continued)

(52) U.S. Cl.

CPC ..... *F42B 5/02* (2013.01); *F42B 10/00* (2013.01); *F42B 10/22* (2013.01); *F42B 10/24* (2013.01); *F42B 10/32* (2013.01); *F42B 10/38* (2013.01); *F42B 10/44* (2013.01); *F42B 33/001* (2013.01); *F41A 1/00* (2013.01); *F42B 12/74* (2013.01)

(58) Field of Classification Search

CPC .. F42B 5/02; F42B 10/00; F42B 10/22; F42B 10/24; F42B 10/32; F42B 10/38; F42B 10/44; F42B 33/001; F42B 12/74; F41A 1/00

See application file for complete search history.

(56) References Cited

U.S. PATENT DOCUMENTS 399,880 A * 3/1889 Graydon ..... F42B 10/14 244/3.27
2,297,130 A * 9/1942 Bomar ..... F42B 10/44 244/3.27

(Continued)

*Primary Examiner* — Michelle Clement

(74) *Attorney, Agent, or Firm* — Naval Surface Warfare Center, Crane Division

(57) ABSTRACT

Various embodiments of optimized subsonic projectiles are provided. For example, one exemplary subsonic projectile can include an elliptical nose cone, a cylindrical body and a boattail with various design features that can be used in a subsonic ammunition cartridge where the subsonic projectile is stabile throughout at least a segment of a flight allowing for better accuracy, maintaining low drag, maximizing range and achieving desired performance while ensuring the projectile stays below the speed of sound and lowering a noise profile of projectile and a launcher firing the projectile.

10 Claims, 11 Drawing Sheets

Related U.S. Application Data

(60) Provisional application No. 62/150,336, filed on Apr. 21, 2015.

(51) Int. Cl.
*F42B 10/22* (2006.01)
*F41A 1/00* (2006.01)
*F42B 12/74* (2006.01)

(56) References Cited

U.S. PATENT DOCUMENTS 2,941,469 A * 6/1960 Barnhart ..... F42B 5/10 244/3.23
3,412,962 A * 11/1968 Killian ..... B64C 7/00 244/130
3,673,286 A * 6/1972 Remaly ..... C06B 21/0091 264/3.1
3,771,451 A * 11/1973 Woodring ..... F42B 5/02 102/430
3,809,339 A * 5/1974 Sieling ..... F42B 10/42 244/3.3
3,923,564 A * 12/1975 Lantz ..... C06B 23/007 149/19.8
3,999,486 A * 12/1976 Bower ..... F16J 15/40 102/526
4,379,531 A * 4/1983 Manis ..... F41A 21/00 244/3.23
4,446,794 A * 5/1984 Simmons ..... F42B 12/70 102/334
4,485,742 A * 12/1984 Mamo ..... F42B 5/02 102/430
4,625,650 A * 12/1986 Bilsbury ..... F42B 12/204 102/364
4,674,706 A * 6/1987 Hall ..... F42B 10/44 102/489
4,850,278 A * 7/1989 Dinkha ..... C04B 35/486 102/501
4,996,924 A * 3/1991 McClain ..... F42B 10/24 102/436
5,062,366 A * 11/1991 Candland ..... F42B 5/02 102/430
5,164,538 A * 11/1992 McClain, III ..... F42B 10/24 102/501
5,259,288 A * 11/1993 Vatsvog ..... F42B 5/307 102/430
5,275,108 A * 1/1994 Chernicky ..... F42B 10/44 102/439
5,349,853 A * 9/1994 Oehler ..... F41J 5/06 102/425
5,429,030 A * 7/1995 Tidman ..... F41A 1/00 102/202.7
5,770,815 A * 6/1998 Watson, Jr. ..... F42B 5/16 102/439
5,798,478 A * 8/1998 Beal ..... F42B 10/44 102/490
5,827,958 A * 10/1998 Sigler ..... F42C 17/04 73/167
5,847,313 A * 12/1998 Beal ..... F42B 12/74 102/516
6,168,111 B1 * 1/2001 Kayser ..... F42B 10/16 244/3.24
6,232,914 B1 * 5/2001 Rose ..... F42B 35/00 342/192
6,283,035 B1 * 9/2001 Olson ..... F42B 5/02 102/439
6,317,946 B1 * 11/2001 Beal ..... F42B 12/74 102/516
6,657,174 B1 * 12/2003 Olsson ..... F42B 10/44 102/501
6,973,879 B1 * 12/2005 McElroy ..... F42B 12/74 102/501
7,070,144 B1 * 7/2006 DiCocco ..... B64C 5/12 244/3.21
7,150,233 B1 * 12/2006 Eberhart ..... F42B 12/74 102/516
7,610,858 B2 * 11/2009 Chung ..... F42B 5/313 102/466
7,779,759 B2 * 8/2010 Paulic ..... F42B 10/22 102/399
8,065,111 B1 * 11/2011 Gonzalez ..... F42B 10/42 702/182
8,222,583 B2 * 7/2012 Fu ..... F42B 10/06 244/3.25
8,487,227 B2 * 7/2013 Rastegar ..... F42B 10/44 244/3.3
9,157,713 B1 * 10/2015 Peterson ..... F42B 8/00
9,182,204 B2 * 11/2015 Maljkovic ..... F42B 33/10
9,200,880 B1 * 12/2015 Foren ..... F42B 33/02
9,316,468 B2 * 4/2016 Rall ..... F42B 33/001
9,453,714 B2 * 9/2016 Bosarge ..... F42B 33/0207
9,644,929 B1 * 5/2017 Bradbury ..... F42B 10/02
9,709,368 B2 * 7/2017 Mahnke ..... F42B 30/02
9,719,762 B2 * 8/2017 Langenbeck ..... F42B 5/025
9,857,155 B2 * 1/2018 Boatright ..... F42B 14/02
9,885,551 B2 * 2/2018 Burrow ..... F42B 5/307
10,139,207 B2 * 11/2018 Adams ..... F42B 10/38
10,317,178 B2 * 6/2019 Burkart ..... F42B 10/22
2002/0190156 A1 * 12/2002 Jensen ..... F42B 10/54 244/3.23
2003/0019385 A1 * 1/2003 LeaSure ..... F42B 5/025 102/444
2003/0131751 A1 * 7/2003 MacKerell ..... F42B 5/02 102/447
2004/0007148 A1 * 1/2004 Vanmoor ..... F42B 5/025 102/501
2004/0094250 A1 * 5/2004 Dixon ..... C06B 23/007 149/19.91
2005/0011507 A1 * 1/2005 Webb ..... F41B 11/57 124/71
2005/0183617 A1 * 8/2005 MacDougall ..... F42B 12/06 102/514
2005/0268521 A1 * 12/2005 Cox ..... F41G 1/38 42/130
2006/0081148 A1 * 4/2006 Beal ..... F42B 5/16 102/441
2006/0278117 A1 * 12/2006 Emary ..... F42B 12/34 102/519
2007/0017409 A1 * 1/2007 Mansfield ..... F42B 12/06 102/518
2007/0261587 A1 * 11/2007 Chung ..... F42B 5/313 102/469
2008/0092768 A1 * 4/2008 Krstic ..... F42B 12/74 102/522
2009/0308275 A1 * 12/2009 Nilsson ..... F42B 12/34 102/524
2010/0010792 A1 * 1/2010 Blevins ..... F41G 3/32 703/7
2010/0282116 A1 * 11/2010 Greenwood ..... F42B 10/38 102/501
2011/0083575 A1 * 4/2011 Dindl ..... F42B 5/02 102/439
2011/0107937 A1 * 5/2011 Thompson ..... F42B 12/74 102/517
2011/0132983 A1 * 6/2011 Sammut ..... F41G 1/00 235/404
2011/0290142 A1 * 12/2011 Luchini ..... F42B 5/16 102/439
2011/0308417 A1 * 12/2011 Glasser ..... F42B 10/42 102/374
2012/0085258 A1 * 4/2012 Emary ..... F42B 12/34 102/439
2012/0180688 A1 * 7/2012 Padgett ..... F42B 5/313 102/466
2012/0180689 A1 * 7/2012 Schuster ..... F42B 5/025 102/469
2012/0291655 A1 * 11/2012 Jones ..... F42B 10/06 102/502

(56) References Cited

U.S. PATENT DOCUMENTS

2013/0167747 A1* 7/2013 Luchini ..... F42B 14/02 102/439
2013/0180424 A1* 7/2013 Kim ..... F42B 10/44 102/501
2014/0060372 A1* 3/2014 Padgett ..... F42B 5/067 102/466
2014/0060373 A1* 3/2014 Maljkovic ..... F42B 33/10 102/467
2014/0130699 A1* 5/2014 Peterson ..... F41A 3/00 102/520
2014/0215876 A1* 8/2014 Popa-Simil ..... F41C 27/22 42/1.06
2014/0318406 A1* 10/2014 Rall ..... F42B 33/001 102/510
2015/0226531 A1* 8/2015 Silvers ..... F42B 5/28 102/439
2015/0241183 A1* 8/2015 Padgett ..... F42B 5/025 102/466
2015/0354930 A1* 12/2015 Fricke ..... F42B 12/34 102/439
2016/0091288 A1* 3/2016 Daniau ..... F42B 5/025 102/439
2016/0131465 A1* 5/2016 Harrison ..... F42B 14/02 102/439
2016/0153757 A1* 6/2016 Mahnke ..... F42B 10/22 102/501
2016/0161212 A1* 6/2016 Bergeron ..... F41B 11/68 124/73
2016/0169644 A1* 6/2016 Ziegler ..... F42B 10/38 244/3.23
2016/0223303 A1* 8/2016 Sloan ..... F42B 5/025
2016/0258726 A1* 9/2016 Sullivan ..... F42B 10/48
2016/0265887 A1* 9/2016 Neu ..... F42B 12/02
2016/0265889 A1* 9/2016 Golloher ..... F42B 12/34
2016/0290774 A1* 10/2016 Langenbeck ..... F42B 5/025
2016/0327380 A1* 11/2016 Kunz ..... F42B 14/02
2017/0089673 A1* 3/2017 Burrow ..... F42C 19/083
2017/0089677 A1* 3/2017 Boatright ..... F42B 14/02
2017/0138709 A1* 5/2017 Oberholster ..... F42B 10/42
2017/0138712 A1* 5/2017 Teig ..... F42B 12/74
2017/0227339 A1* 8/2017 Adams ..... F42B 10/40
2017/0233306 A1* 8/2017 Kwon ..... C06B 25/34 149/92
2017/0254621 A1* 9/2017 Sammut ..... F41G 1/38
2017/0276463 A1* 9/2017 Tubb ..... F42B 5/03
2017/0297112 A9* 10/2017 Burrow ..... C22C 38/58
2017/0299356 A1* 10/2017 Stakes ..... F42B 12/44
2017/0314900 A1* 11/2017 Mahnke ..... F42B 12/06
2017/0322001 A1* 11/2017 Panousakis ..... F42B 5/02
2017/0322002 A1* 11/2017 Mahnke ..... F42B 12/06
2018/0038673 A1* 2/2018 Fridlund ..... F42B 33/00

* cited by examiner

TABLE 1

| Temp [C] | @ Mach 1.0 [m/s] | Sphere [m/s] | NACA 0012 [m/s] | @ Mach 0.8 [m/s] |
|---|---|---|---|---|
| -40 | 306.071 | 173.7567042 | 225.6051905 | 244.8570783 |
| -35 | 309.336 | 175.6099638 | 228.0114573 | 247.4686825 |
| -30 | 312.566 | 177.4438686 | 230.3925939 | 250.053012 |
| -25 | 315.764 | 179.2590127 | 232.7493716 | 252.610904 |
| -20 | 318.929 | 181.0559603 | 235.0825231 | 255.1431535 |
| -15 | 322.063 | 182.835248 | 237.3927449 | 257.6505168 |
| -10 | 325.167 | 184.5973863 | 239.6807001 | 260.1337133 |
| -5 | 328.242 | 186.3428618 | 241.9470204 | 262.5934287 |
| 0 | 331.288 | 188.0721385 | 244.1923081 | 265.0303168 |
| 5 | 334.306 | 189.7856592 | 246.4171382 | 267.4450014 |
| 10 | 337.298 | 191.4838467 | 248.6220599 | 269.8380789 |
| 15 | 340.263 | 193.1671056 | 250.8075982 | 272.2101188 |
| 20 | 343.202 | 194.8358227 | 252.9742556 | 274.5616667 |
| 25 | 346.117 | 196.4903686 | 255.1225131 | 276.8932444 |
| 30 | 349.007 | 198.1310982 | 257.2528316 | 279.2053524 |
| 35 | 351.873 | 199.758352 | 259.3656531 | 281.4984703 |
| 40 | 354.716 | 201.3724567 | 261.4614019 | 283.7730586 |
| 45 | 357.537 | 202.973726 | 263.5404852 | 286.0295593 |
| 50 | 360.335 | 204.5624613 | 265.6032944 | 288.2683972 |
| 55 | 363.112 | 206.1389524 | 267.6502058 | 290.4899806 |
| 60 | 365.868 | 207.7034782 | 269.6815814 | 292.6947024 |
| 65 | 368.604 | 209.2563069 | 271.6977696 | 294.8829408 |
| 70 | 371.319 | 210.7976971 | 273.6991061 | 297.0550602 |

FIG. 5

101

Determine a caliber of the projectile 11 associated with a projectile launcher and casing 20 combination that will fit within a first fit dimension determined based on a chamber length of the projectile launcher and a non-interference fit diameter of a passage through a barrel of the projectile launcher, wherein the projectile 11 comprises a first, second, and third section, the first section is a nose cone 1 section, the second section is a body 3 section, and the third section is a boattail 5 section, wherein the casing 20 comprises a throat 26 area configured to receive and pressfit to a section of the second section and a primer 43 disposed on an opposing end of the casing 20 from the throat 26 area, the first section comprises an elliptical nose cone 1 shape, the second section comprises a cylindrical shape, and the third section is formed in a cone shape, wherein the third section is formed with a plurality of rebated 45 or stepped 46 structures, the first section is formed with a flat meplat 38 on a top of a center section of the first section, wherein the projectile 11 is formed with a second section to third section transition having an angle of eight degrees as defined by a first plane collinear with an external surface of the second section and a second plane collinear with an external surface of the third section, wherein the first, second, or third sections are formed with at least one turbulence generator comprising a ring or groove 48 structure formed into the first, second, or third sections that is perpendicular to a first axis formed by a line drawn from a center of the first section to a center of an end of the third section, wherein said projectile 11 is formed with a center of pressure that is further from a central terminal tip of the nose cone section along the first axis than a center of gravity, wherein the projectile's 11 interior first section can be comprised of tungsten and the second section and third can be comprised of aluminum;

103

Determine a length of a the third section based on an available area within said casing 20 defined as a length of said boattail 5 that runs in proximity to the throat 26 from a transition between the second and third sections to a location in proximity but not in contact with the primer 43;

FIG. 15A

OPTIMIZED SUBSONIC PROJECTILES

CROSS-REFERENCE TO RELATED APPLICATIONS

The present application claims priority to and is a continuation of U.S. patent application Ser. No. 14/953,315, filed Nov. 28, 2015, entitled "OPTIMIZED SUBSONIC PROJECTILES AND RELATED METHODS," which claims priority to U.S. Provisional Patent Application Ser. No. 62/150,336, filed Apr. 21, 2015, entitled "OPTIMIZED SUBSONIC PROJECTILES," the disclosures of which is expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon. This invention (Navy Case 200,585) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to aerodynamics relative to ballistic objects that are designed to lower noise, improve stability, maximizing maintaining velocity, and adjusting drag characteristics by means of various structural and material aspects as well as methods related thereto. In particular, embodiments include designs and methods associated with ammunition for firearms, and more particularly to subsonic ammunitions, that are capable of lowering a noise profile of a gun while having a consistent minimized drop over a distance the projectile travels. An alternative embodiment can also address designs and methods associated with the projectile and charge combination that facilitates a maximum sub-sonic speed at a given set of temperature ranges as force applied to the projectile can vary based on propellant temperature due to factors such as ambient temperatures.

As some background, ballistics can address four phases. A first phase can be termed "internal ballistics" which can cover behavior of the projectile from a time the projectile's propellant is initiated until the projectile exits a barrel. A second phase can be termed "transitional ballistics" which can cover the projectile's behavior from a time the projectile leaves the barrel's muzzle until pressure behind the projectile equalizes. External ballistics can cover behavior of the projectile after it exits the barrel/propellant pressure equalization until immediately before impact with a target. Terminal ballistics can cover behavior of the projectile when it hits its target.

While in the transitional ballistics phase, the projectile is still being propelled forward. A maximum velocity is reached at the end of the transitional ballistic phase and the beginning of the external ballistic phase. Maximum velocity of the projectile can be a primary constraint and/or concern in determining the characteristics and profile of the projectile at subsonic speeds. Multiple physical properties influence results of each of the four ballistic phases such as, for example, mass, sectional density, and aerodynamic shape.

External ballistics can have a substantial impact when determining characteristics and profile of the projectile. A design for the external ballistic phase can be determined by modifying physical properties and structural aspects that influence a projectile. One main goal when modifying these properties can include maintaining velocity and stability of the projectile as far down range as possible.

Terminal ballistics can refer to behavior and effects of the projectile when it hits a target. In some cases, a high velocity, deeper penetration projectile with a large hole is most desired. The shape, mass, and velocity of the projectile can influence penetration, so the initial kinetic energy when a projectile arrives at the target can provide general terminal ballistic characteristics. For terminal ballistic considerations, a terminal kinetic energy of the subsonic projectile can be calculated, and different aspects of structure/material associated with subsonic attributes are balanced against terminal ballistics considerations. Additionally, penetration of the subsonic projectile and a propellant weight for subsonic ammunition can be calculated to determine if the terminal ballistics of the subsonic projectile are effective.

Exemplary designs and methods associated with this disclosure can produce designs with a consistent trajectory and consistent drop while maintaining control of a projectile as well as ensuring that the projectile stays below the speed of sound in certain ballistics phases. Some exemplary designs of subsonic ammunition can address some or all four ballistic phases: internal, transitional, external, and terminal. By creating methods and designs that address the various ballistic phases, a profile of some embodiments of the exemplary subsonic projectile can be determined which can reduce ballistic drop, balance aerodynamic effects, maintain low drag, and factor in propellant charge considerations at varying temperatures. The present disclosure includes methods to determine optimal characteristics of subsonic ammunition and presents some exemplary embodiments of such a projectile.

One problem statement for an exemplary embodiment of this disclosure or the invention can include designing a projectile that, when fired at subsonic speeds, has improved ballistic characteristic over a supersonic projectile fired at subsonic speeds. Desired performance for some embodiments of the invention can include the following: maximizing an initial velocity as the projectile leaves a barrel, minimizing a reduction of velocity as the projectile travels down range, consistent flight trajectory (e.g., minimize dispersion, maximize precision). A trade-off can be whether precision (i.e. how closely the projectile impact points are grouped together) is more important than accuracy (i.e. how close an impact point is to the aim point). This tradeoff can be determined since aim point (and therefor accuracy) could always be adjusted once the projectile trajectory has been characterized and is known by a user, but precision could not be adjusted by the user in a similar manner.

An illustrative embodiment of the present disclosure can include a subsonic ammunition cartridge assembly comprising a projectile and a casing having a base end and an open end to receive the projectile. An optimized subsonic projectile can be designed having an elliptical nose cone, a body, and boattail section. The projectile can be sized to fit within the open end of the casing and can have structural aspects, e.g., meplat, nose shape/length, body shape/length, boattail shape/length, grooves, rebated or stepped sections, tail shape/length, etc, as well as charge disposed within the casing that collectively exhibit a desired degree of stability at subsonic velocity during, e.g. an external ballistics phase, as well as addressing drop, maximizing velocity at particular stages, etc. Different materials can be used for projectile designs that provide various effects to include external and terminal ballistics phase effects. In some embodiments, desired designs should strive to produce a highest minimum pressure coefficient as possible associated with the projectile during a subsonic external ballistics phase. In some embodiments, a desired design will provide the projectile with a highest maximum subsonic velocity. Pressure coefficient can also be a function of a thickness on a projectile object (e.g., a diameter). Associated methods are also provided to include methods of designing, manufacturing, assembly, and use.

Any additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which:

FIG. 5 shows Table 1 that illustrates the effect of temperature on a subsonic projectile;

FIGS. 15*a* and 15*b* shows an exemplary embodiment of a method of manufacturing an optimized subsonic projectile;

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
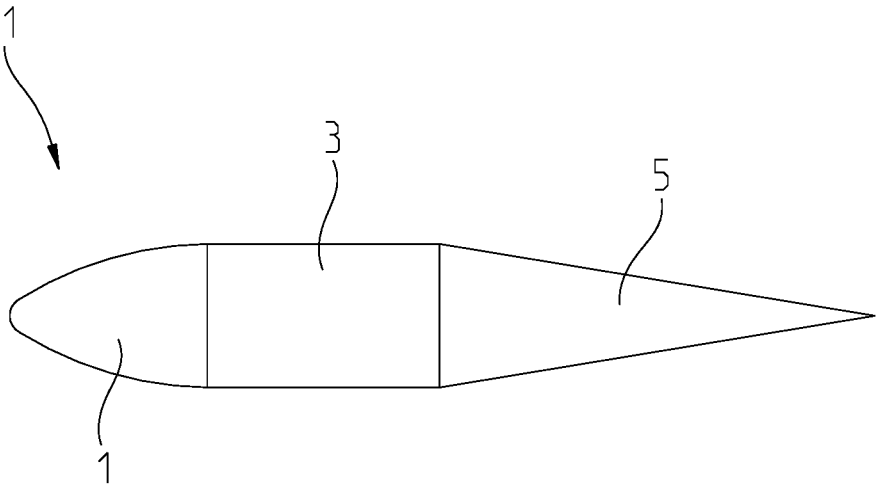
FIG. 1 shows a simplified exemplary embodiment of an optimized subsonic projectile.

As shown in FIG. 1, an exemplary projectile design can be determined by examining three components of a projectile 11: a nose cone 1, a body 3, and a boattail 5 with the body 3 disposed between the nose cone 1 and the boattail 5. An exemplary simplified subsonic projectile 11 that can provide an ideal aerodynamic shape for the subsonic projectile 11 can include an elliptical shape of the nose cone 1 that gradually increases in diameter, a cylindrical shape of the body 3 that can have a consistent diameter, and the boattail 5 can have a shape that gradually decreases in diameter reaching an apex at the end of its length.

Figure 2:
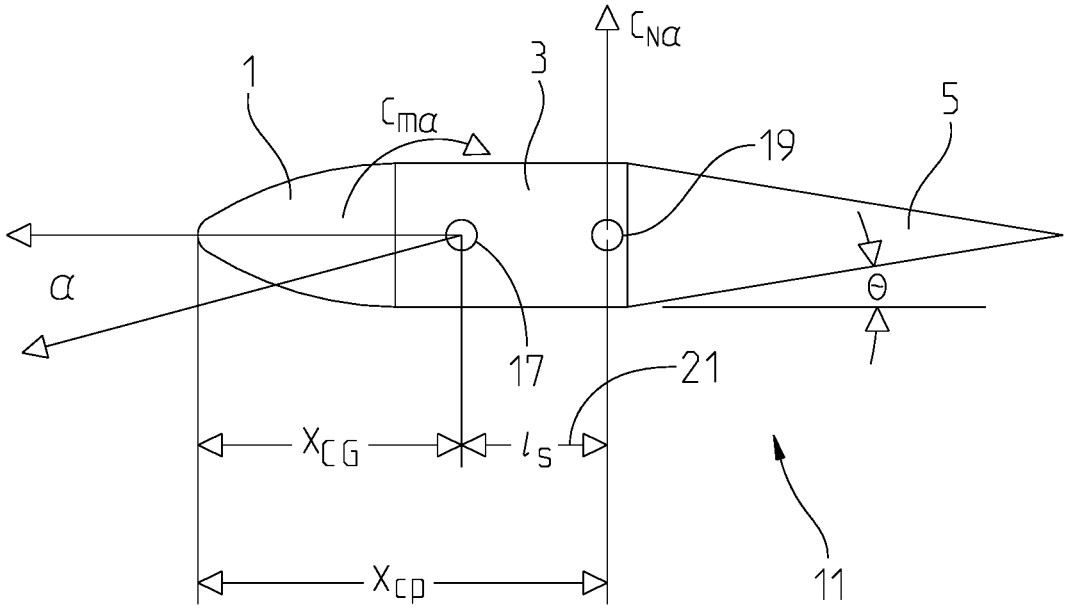
FIG. 2 shows an exemplary embodiment of an optimized subsonic projectile showing some forces that that can be evaluated to determine static stability.

Referring to FIG. 2, a free-body diagram is shown with various forces that the exemplary projectile 11 can experience when determining static stability of the projectile 11. One goal of an external ballistics phase design effort can be designing the projectile 11 to maintain velocity and stability as far down range as possible. To do this, several aerodynamic parameters can be considered. As with a subsonic constraint, boundary conditions for design parameters can be determined to help identify a design solution space. The exemplary parameters can then be used to calculate other ballistic phases if desired. Coefficient of pressure (Cp) can be used to evaluate speed of the projectile 11. Coefficient of drag (CD) can be used to evaluate how far the projectile 11 goes. Stability influences accuracy, range, and velocity of the projectile 11. Static stability is related to a center of pressure (CoP 19) defined in relation to a center of gravity (CG 17) that is measured relative to a stability length (ls) 21. Gyroscopic stability (Sg) can be based on Fineness Ratio, Twist Rate and Mass. Static stability of the projectile 11 can be related to a restoring moment when a longitudinal axis is rotated from the projectile's 11 flight axis. Aerodynamic forces can be applied at the CoP and create a moment about the CG of the projectile 11. A crosswind can create a relative angle of attack and a normal force on the projectile 11. A CoP aft of the CG can produce a moment that can turn the projectile's nose cone 1 into a wind and reduce wind drift. In other words, in this example Xcp minus Xcg is ls and ls should be positive (a number greater than zero). So in this example, a CoP behind a CG will rotate the tail of the projectile 11 around the CG. A CoP in front of the CG can produce a moment that can turn with the wind and can increase wind drift.

Equation 1 shows a calculation for the location of CG.

$$X_{CG} = \frac{m_{nose} X_{CG_{Nose}} + m_{body} X_{CG_{body}} + m_{boattail} X_{CG_{boattail}}}{m_{total}}$$

Equation 2 shows a normal force coefficient gradient summation.

$$(C_{N\alpha})_T = (C_{N\alpha})_{nose\text{-}cylinder} + (C_{N\alpha})_{boattail}$$

Equation 3 shows a pitching moment coefficient gradient summation.

$$(C_{m\alpha})_T = (C_{m\alpha})_{nose\text{-}cylinder} + (C_{m\alpha})_{boattail}$$

Equation 4 presents a calculation for the CoP.

$$(X_{cp})_r = d\left(\frac{(C_{m\alpha})_r}{(C_{N\alpha})_r}\right)$$

-continued $$(X_{cp})_r = d\left(\frac{\left[(2(k_2-k_1))\left(\frac{A_b}{A_{ref}}\right)\left(\frac{X_{cp_{bt}}}{l_{ref}}\right)\right]+\left[\left(\frac{-2A_{bt}}{A_{ref}}\right)\left(1-\left(\frac{d_{bt}}{d}\right)^2\right)\left(\frac{X_{cp_{bt}}}{l_{ref}}\right)\right]}{\left[(2(k_2-k_1))\left(\frac{A_b}{A_{ref}}\right)\right]+\left[\left(\frac{-2A_{bt}}{A_{ref}}\right)\left(1-\left(\frac{d_{bt}}{d}\right)^2\right)\right]}\right)_r$$

Equation 5 expresses normal force coefficient gradient for small angles of attack.

$$C_{N\alpha} = \frac{N}{q_\infty A_{ref}}$$

In some embodiments, small angles of attack can be assumed, and a projectile's cylindrical body 3 may not directly influence stability. The projectile's boattail 5 CoP (e.g., as measured from the nose cone Xcp) can be minimized. An exemplary shorter cylindrical body 3 can move the boattail 5 closer to the nose cone 1, and can improve the CoP location. In some embodiments, CoP for the projectile's boattail 5 normal force can be located at about 60% of the boattail 5 length downstream of a body-boattail juncture. The projectile's boattail 5 normal force can also act in an opposite direction from the projectile's nose cone's 1 normal force. In this example, this means that the projectile's boattail 5 can move a total CoP forward of a nose cone's 1 CoP, which may be opposite from a desire effect (e.g., stability).

Figure 3:
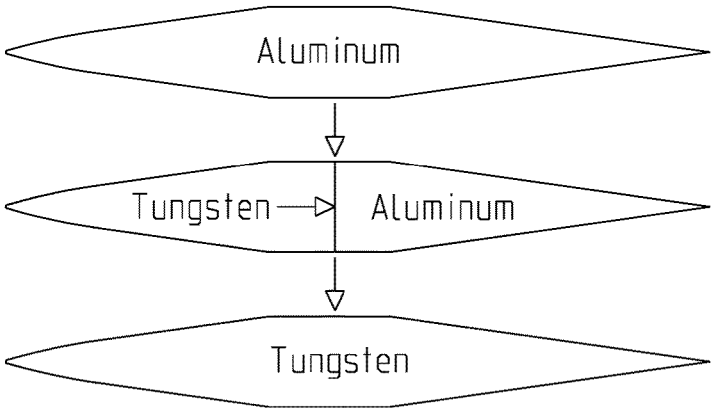
FIG. 3 shows an inner material composition that can vary in an exemplary embodiment of a subsonic projectile.

In some exemplary embodiments, a CG location in the subsonic projectile 11 can be brought closest to the projectile's nose cone 1 tip as possible by varying materials in projectile's 11 composition, such as, for example, aluminum, and tungsten, as shown in FIG. 3. In some exemplary embodiments, an exemplary combination of materials and moving and determining its CG for the projectile 11 can be evaluated by starting with an aluminum round and changing sections of the projectile 11 to tungsten starting, for example, from the nose cone 1. Changes can be done to move a CG around, for example, until the entire projectile 11 is tungsten as shown in FIG. 3. In certain embodiments aluminum and tungsten can be selected as an extreme scenario to magnify a center of gravity shift curve. However, in an exemplary embodiment actual materials used can vary, but a location of less dense and/or denser materials can be the same. This design process can be repeated for a minimum and maximum volume of the projectile's nose cone 1 and minimum and maximum volume of the projectile's boattail 5, and thus shift the particular projectile's CG toward or away from the projectile's nose 1 cone's tip.

In certain embodiments, a CG can also change when the projectile 11 has a long nose cone 1 in comparison to a short nose cone 1 of the same nose cone profile. Additionally, a CG can change when the projectile's boattail 5 length is lengthened or shortened. In some embodiments, the longer the projectile's nose cone 1, the more stable the projectile's 11 flight can be. The projectile's boattail 5 length can vary where an embodiment of a subsonic projectile has a long or short boattail 5 length that increases stability. In some exemplary embodiments, a short or long boattail 5 can be preferred, because a medium length boattail 5 can decrease stability.

Figure 4A:
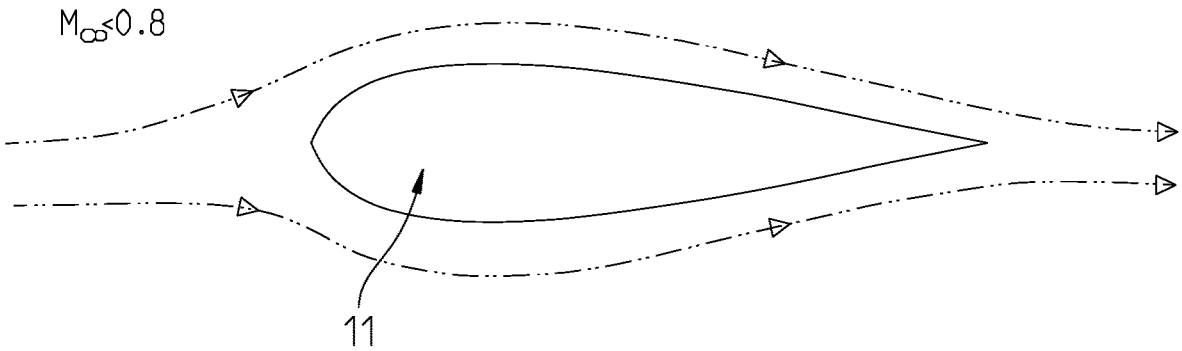
FIG. 4*a* shows a simplified exemplary embodiment of an optimized subsonic projectile with typical subsonic flow.
Figure 4B:
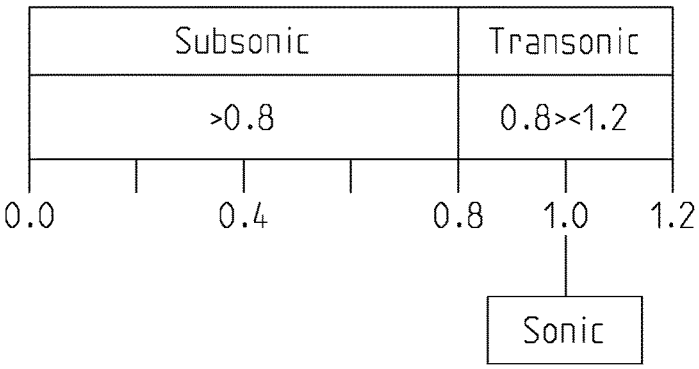
FIG. 4*b* shows sonic regimes, such as, for example, subsonic, transonic, and supersonic.

In some embodiments, air around the projectile 11 can travel faster than the projectile 11, and can reach supersonic speeds before the projectile 11 does. FIG. 4*a* shows one sonic regime considered for one projectile 11. In an exemplary embodiment, both airflow and the projectile 11 can remain subsonic. Testing and analysis determined that in some embodiments shape and length of an exemplary nose cone 1 can have a significant influence on a maximum subsonic velocity possible while still remaining subsonic. Design and analysis work was conducted on selecting nose shapes that allows for an exemplary projectile 11 to travel as fast as possible while keeping the air around the projectile 11 subsonic. Moreover, a local speed of sound adjusts the projectile's 11 speed of sound to account for temperature in the area in which the projectile 11 flows through. Maintaining subsonic flow throughout a flow field can be critical to preventing a shock wave and, therefore, preventing a sonic boom. A Mach number may be different at different points throughout a flow field. A Mach number less than 0.8 at every point is considered subsonic as shown in FIG. 4*b*. For slender bodies such as, for example, the exemplary projectile 11, a recommended guide for keeping both the projectile 11 and the air flow around it subsonic can be keeping a freestream Mach number equal to or less than 0.8, thereby maintaining subsonic flow. One design consideration is ensuring a propellant charge is designed, selected, and disposed into an exemplary casing (e.g., see FIG. 9, 20) to maximize subsonic speed of the projectile as it enters the external ballistics phase to no more than a critical Mach number (e.g., less than Mach 1) at an ambient temperature at which the projectile 11 is functioning.

Referring to FIG. 5, Table 1 shows generally how maximum velocity varies with temperature and critical Mach number. Generally speaking, a projectile with a maximum cold weather velocity can have suboptimal hot weather velocity, which can greatly affect the range of a projectile in hot weather. Similarly, a projectile with a maximum hot weather velocity can be supersonic in cold weather, which can result in poor flight characteristic as the projectile is not designed for supersonic flight and, as a result, can produce a sonic boom. Operational conditions can be applied when determining the optimal subsonic projectile 11 to further restrict temperature difference. A design can produce a highest minimum Cp, which can allow for a highest maximum velocity. A Cp can be related to the thickness of a projectile such as, for example, a diameter.

Figure 6:
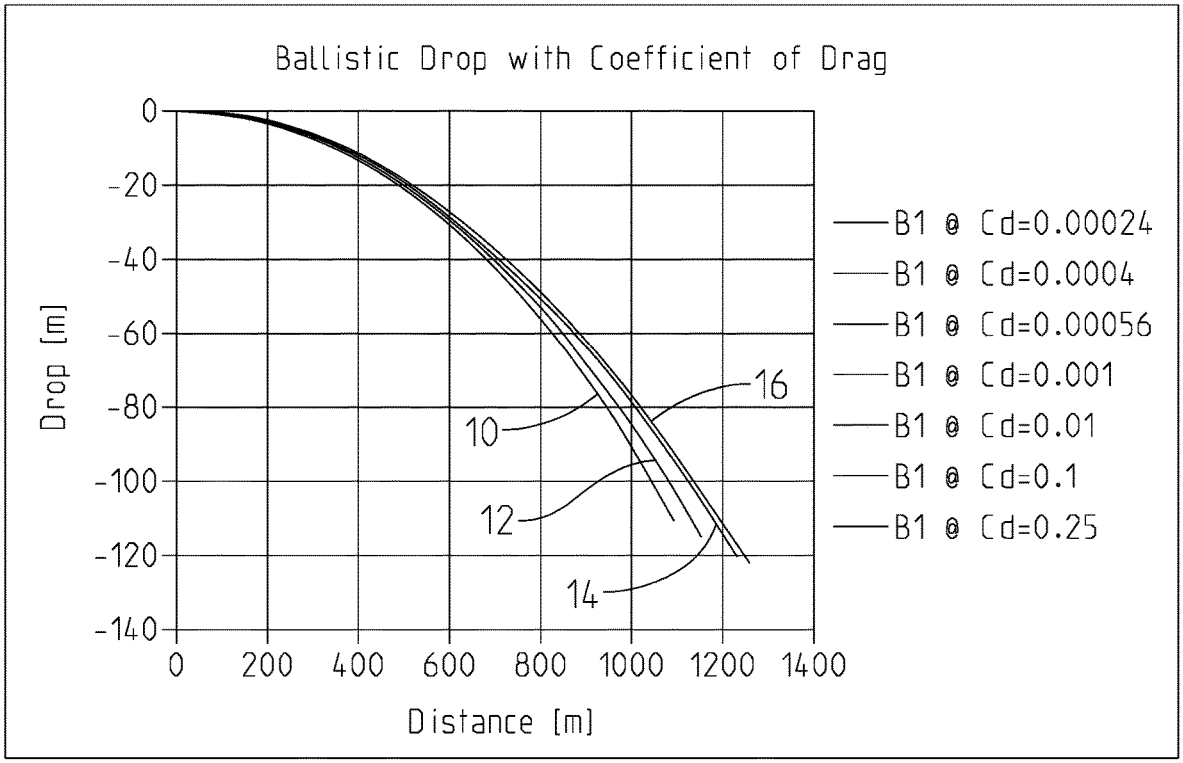
FIG. 6 shows a ballistic drop v. distance and an exemplary projectile's related coefficient of drag.

In some embodiments, a ballistic model can be created to show horizontal velocity decay as the projectile 11 travels down range. FIG. 6 shows ballistic drop as the projectile 11 travels down range with respect to various CDs of the projectile 11. A CD of 0.25 (10) drops faster compared to a CD of 0.1 (12), and a CD of 0.01 (14), whereas a CD of 0.00024 (16) can travel the furthest and drop the least over a longest distance.

Figure 7:
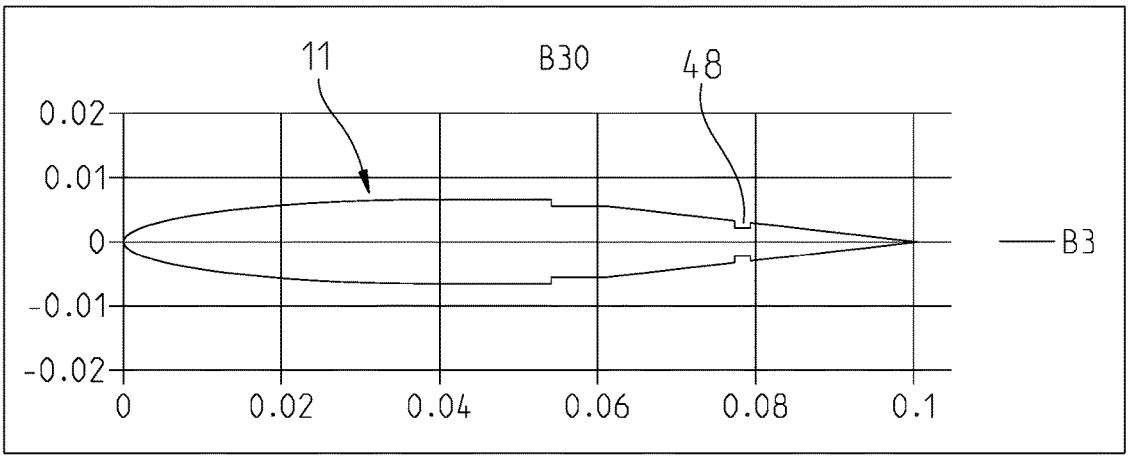
FIG. 7 shows an exemplary embodiment of a subsonic projectile having grooves in an exemplary boattail section.

An exemplary design can also include a focus on eliminating or reducing pressure drag (drag from airflow separating from the projectile) rather than reducing skin friction drag. To eliminate pressure drag in this embodiment, two elements of design were determined. First, an angle of the projectile's tail (See FIG. 2, angle θ) was set as low as possible, preferably below 8 degrees in some embodiments. Angles greater than eight degrees can also lead to flow separation. Second, as shown in FIG. 7, grooves 48 formed into an outer circumference of along nose cone 1, body 3, and/or boattail 5 sections that function as turbulence generators can be added along a length of an exemplary projectile 11. These grooves 48 each provide a consistent turbulence tripping point around the projectile 11 while spinning. Dimensions and locations of the grooves 48 (i.e.

turbulence generators) can be determined by a caliber of the projectile 11. A trade-off can be made such that a selected nose profile was not a lowest for skin friction drag. Maximum initial velocity can be determined as more important than minimum skin friction drag. In one embodiment, skin friction drag was determined to not have a significant influence on the projectile design and can be ignored.

In other embodiments, given a streamlined body, most of a drag can be skin friction drag. If the projectile's 11 velocity is below a critical Mach number and no flow separation occurs, then the projectile's 11 pressure drag can be zero. Flow separation at subsonic speeds can cause significant pressure drag. Laminar and turbulent flow can impact flow separation. Laminar flow can provide for a lower skin friction drag; however, airflow can also separate from the body 3 causing a higher-pressure drag. Turbulent flow can have a higher skin friction drag; however, it does not separate as easily from the exemplary body 3 and therefore reduces the likelihood of pressure drag. Maintaining laminar flow can be difficult and can be impractical in some actual conditions. Designs or embodiments that prevent flow separation can create turbulent flow that can be worse than laminar flow that, in certain embodiments, can motivate to include design aspects that induce turbulent flow (e.g., by turbulence generators such as grooves 48).

Figure 8A:
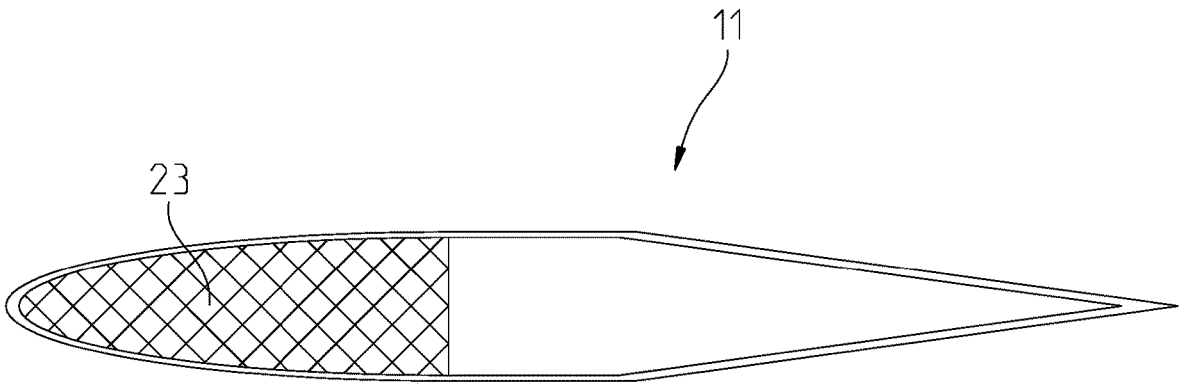
FIG. 8*a* shows an exemplary embodiment of a subsonic projectile having a full metal jacket with a tungsten nose cone and an aluminum body and boattail.
Figure 8B:
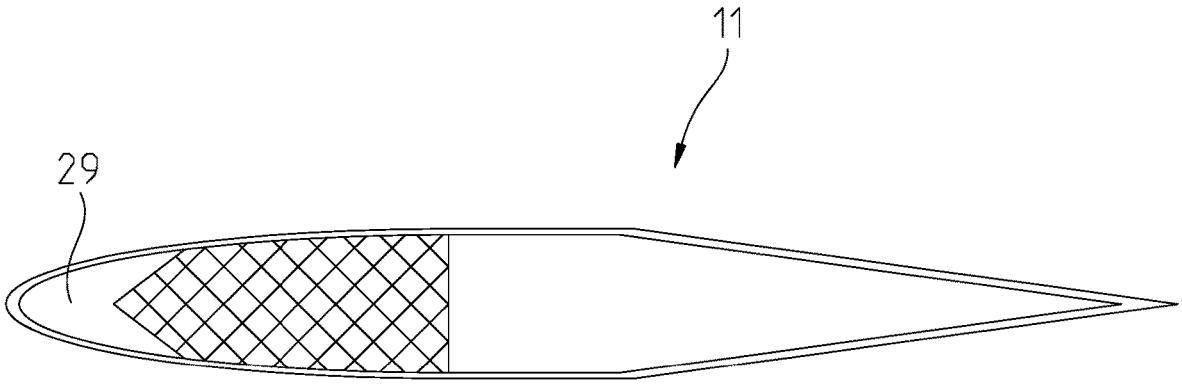
FIG. 8*b* shows an exemplary embodiment of a subsonic projectile having hollow point at the tip of the nose cone.

Now referring to FIGS. 8*a* and 8*b*, an exemplary embodiment of the subsonic projectile 11 can have a full metal jacket 23 or hollow point 29 depending on desired terminal ballistics properties. In general a higher velocity, a deeper penetration, and a larger hole are more desirable. These parameters can be influenced by the external and internal design of the projectile 11. The internal design of the projectile 11 should be based on a type of an intended target and the desired effect. FIG. 8*a* shows a cross-section of an exemplary embodiment of the subsonic projectile 11, with tungsten in a front portion and aluminum in a middle and an aft portion. As the internal design is modified, e.g., hollow point 29, the projectile's static stability is impacted, as shown in FIG. 8*b*.

Figure 9:
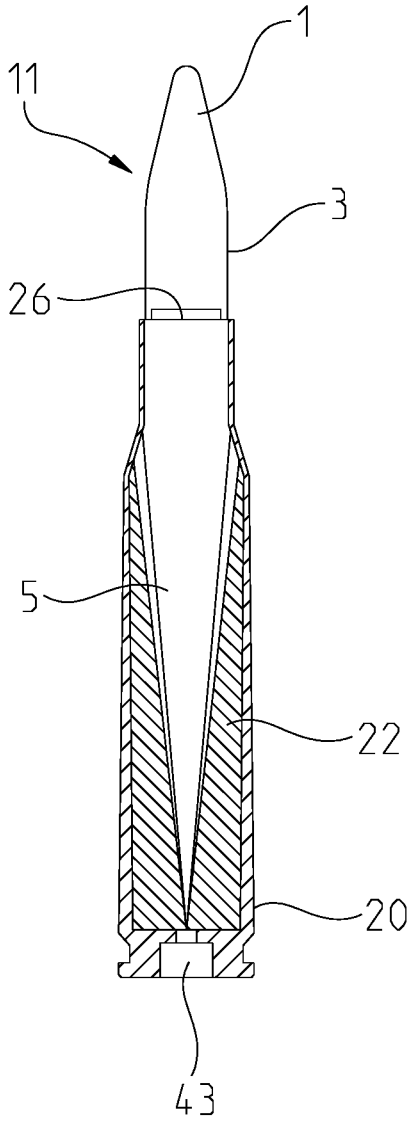
FIG. 9 shows an exemplary embodiment of an ammunition cartridge containing a partial view of an exemplary subsonic projectile.

Referring to FIG. 9 an exemplary subsonic projectile 11 with a nose cone 1, body, 3, and conical boattail 5 fitted into a casing 20 having a throat 26. In this exemplary embodiment the projectile 11 can have its boattail 5 extend from the throat 26 to a primer 43 of the casing 20 but not in contact with the primer 43. In this manner, the projectile 11 can be as long as the casing 20 and therefore as long as a gun chamber (not shown) can allow, which can maximize initial projectile velocity. The projectile's 11 length can influence a Cp such as, for example, as the body 3 gets longer a Cp can increase. The projectile's 11 internal ballistics can be controlled using a propellant 22 that can utilize the projectile's casing 20 remaining internal area after the projectile 11 has been inserted into the throat 26 in the casing 20, which can allow for a maximum amount of propellant 22 to fit into the casing 20. It should be understood that the projectile 11 may include various design features such as those discussed in this document (e.g. grooves 48, a CoP aft of its CG, a body 3 to boattail 5 transition angle/angle θ of 8 degrees or less, an elliptical nose 1, etc.). One exemplary design consideration can include ensuring that the propellant 22 is designed/selected and disposed into the casing 20 surrounding the conical boattail 5 to maximize subsonic speed of the projectile 11 as it enters the external ballistics phase to no more than a critical Mach number (e.g., less than Mach 1) at an ambient temperature at which the projectile 11 is functioning.

An embodiment can also include a design to achieve consistent flight trajectory that can entail a design to maximize inflight stability. Several design elements and determinations were determined to maximize inflight stability in some exemplary embodiments. First, the boattail 5 length can be maximized based on the projectile 11 casing 20 used that can still fit into a chamber. A maximum boattail 5 length also can support a minimum tail angle θ and support a maximum initial velocity. Second, a length on the exemplary projectile's body 3 can be minimized while keeping the projectile body's 3 diameter constant and approximately equal to a caliber of a barrel sufficient to permit firing through the barrel without significant damage to the projectile 11. A short body 3 for stability conflicts with a long body 3 for maximum initial velocity. A trade-off can be accomplished whereas a minimum body 3 length can be selected for one embodiment. Third, the projectile's 11 CG can be shifted as far forward as possible by means of, e.g., material selection or a composite of material. A trade-off in this exemplary embodiment can be that a longer boattail 5 pulls the CG to the rear that can impact stability. Different materials can be used to provide a long boattail 5 while pushing the CG as far forward as possible. Fourth, flat spots can be added to the boattail 5 to equalize pressure around the boattail 5 so the projectile 11 would be pushed straight from charge gas expansion and/or movement in the chamber and barrel (e.g. see rebated 45 and stepped 46 boattails in FIG. 13).

In an exemplary embodiment, a critical Mach number can be used to determine a maximum subsonic velocity of the projectile 11. In some embodiments higher maximum projectile subsonic velocity creates improved ballistic properties that are balanced against other aspects of the invention. A Cp can be related to a freestream Mach number and a local velocity of the projectile 11. A projectile's maximum critical Mach number and maximum Cp for the projectile 11 can be obtained by determining a freestream Mach number and relating it a minimum pressure coefficient.

Figure 10:
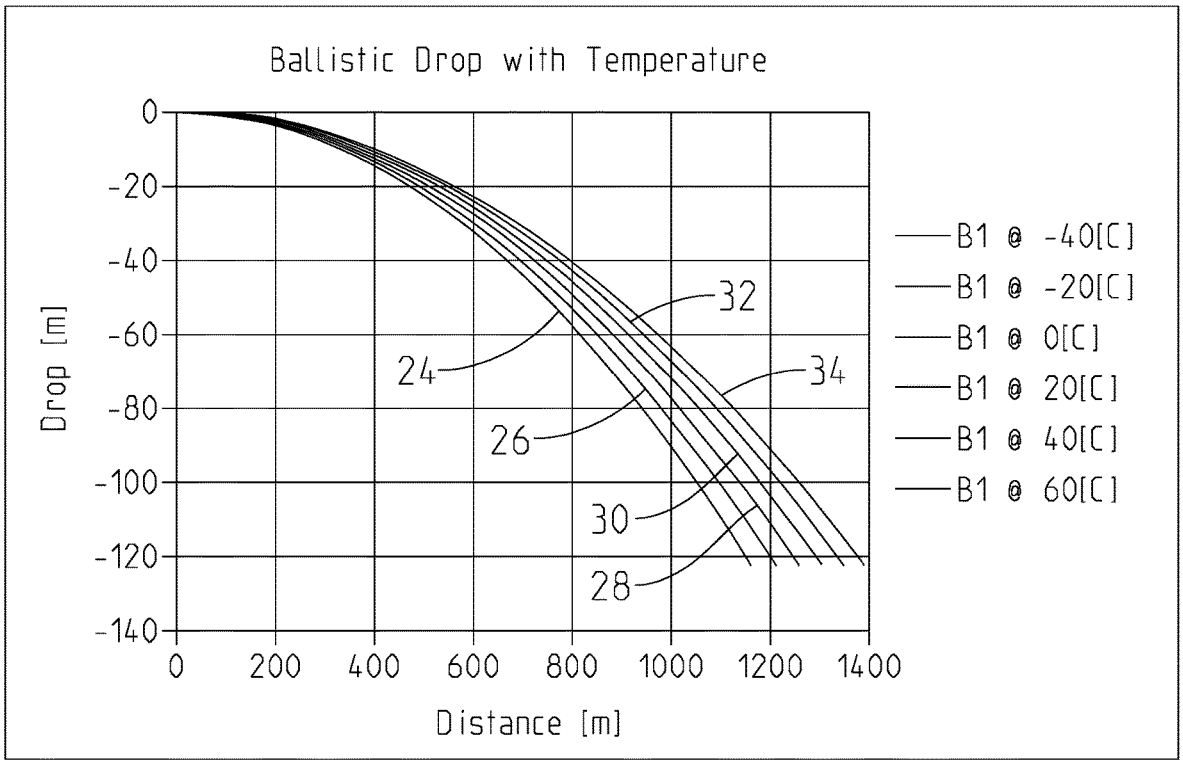
FIG. 10 shows an exemplary projectile's drop v. distance at certain temperatures.

Charge and temperature can impact subsonic external ballistics. FIG. 10 shows data results that can be used to evaluate performance of the exemplary projectile 11 based on temperature such as, for example, at −40 degrees C. 24, where a projectile drops faster than at −20 degrees C. 26, 0 degrees C. 28, 20 degrees C. 30, 40 degrees C. 32, and 60 degrees C. 34. Additionally, propellant 22 that can change its produced propulsive force with temperature can be used which can allow for the optimal muzzle velocity through all temperature environments. By using propellant 22 that changes with temperature, an optimal muzzle velocity can be maintained through all temperatures such as, for example, when the temperature is cold the propellant 22 can produce less pressure, and therefore less muzzle velocity, and for warm temperatures, the propellant 22 can produce higher pressures, and therefore more muzzle velocity.

Figure 11:
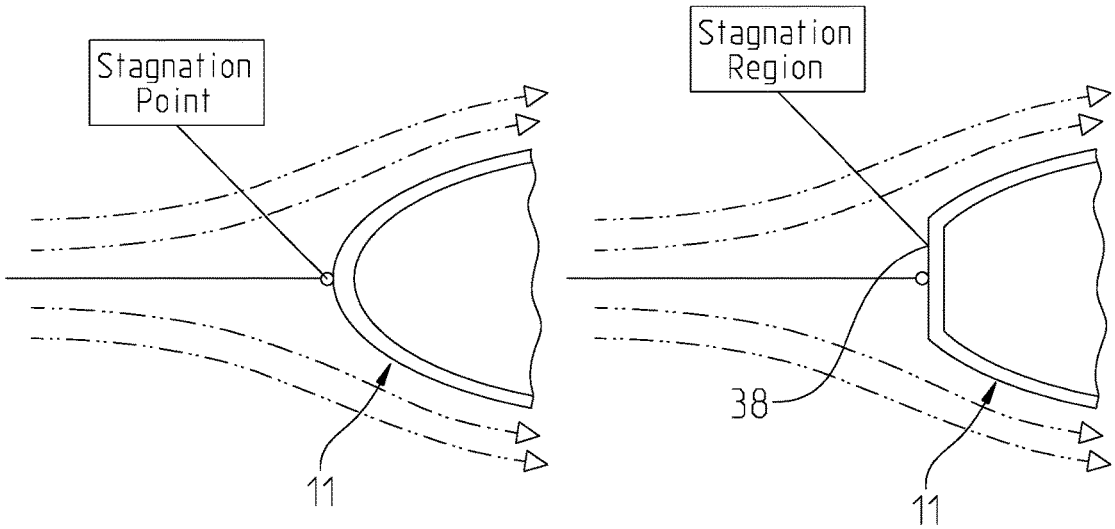
FIG. 11 shows an exemplary nose cone of the subsonic projectile having a meplat.

Referring to FIG. 11 in certain embodiments a meplat 38 (or flat front) can be added to the exemplary projectile's nose cone 1. The meplat 38 can provide several advantages to the subsonic projectile 11 such as, for example, creating early turbulence generation, which can help prevent flow separation along the projectile's nose cone 1 and at the projectile's nose-body interface. In addition, the meplat 38 can improve terminal effects by increasing impact damage, e.g., a permanent wound channel that is created by tearing a target rather than pushing it out of the way. Additionally, the meplat 38 can aid in armor penetration. Furthermore, the meplat 38 can simplify a manufacturing process and provide for more consistent projectiles 11. An exemplary embodiment of the meplat 38 can stay within a stagnation point/region of the projectile's nose cone 1, which reduces or eliminates additional drag on the projectile 11.

Figure 12:
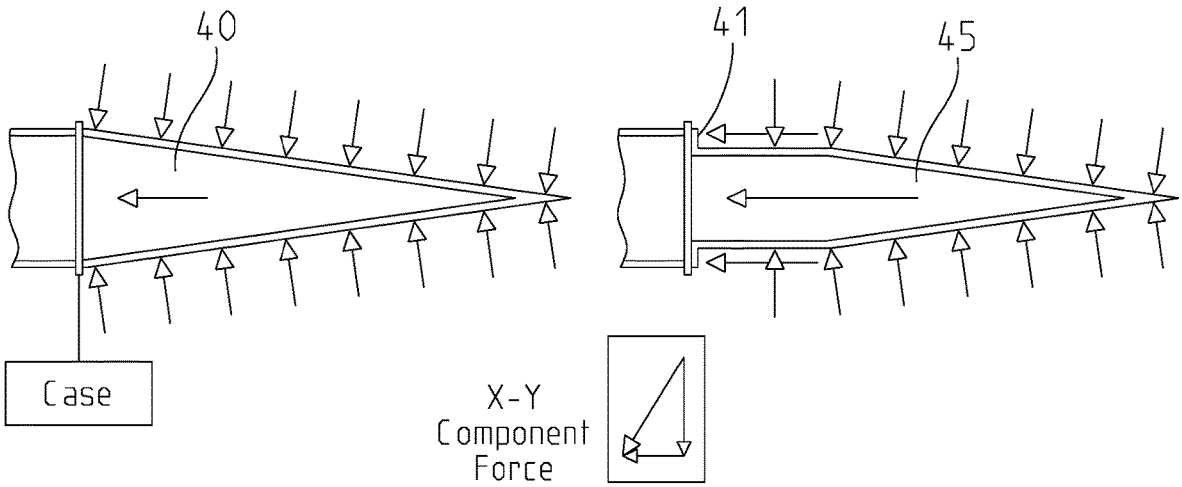
FIG. 12 shows various pressures exerted on a boattail as well as various pressures exerted on a rebated boattail of a subsonic projectile.

FIG. 12 shows pressure differences between a rebated 42 and non-rebated boattail 40. The rebated boattail 45 comprises a right angle step 41 from the body 3 section of the exemplary projectile 11. The right angle step 41 can disrupt muzzle gas flow, and can add a better seal between a casing's 20 bore and the projectile 11. Use of the rebated boattail 45 provides advantage such as, for example, increased stability, reduced drag, and increased rifling engagement. Use of the rebated boattail 45 can result in reactant forces such that pressure reacts perpendicularly to the rebated boattail's 45 surface. In an exemplary embodiment the rebated boattail 45 can have an eight-degree angle from its right angle step 41, which can allow for a small percentage of pressure to propel the projectile 11 forward. Adding the rebated boattail 45 can provide a vertical face for the pressure to act on and can increase the forward velocity of the projectile 11 as shown in FIG. 12. A rebated boattail 45 size can be designed to minimize pressure drag, maximizing stability, and maximizing forward velocity. If the projectile's rebated boattail 45 is too large, then a pressure drag can be induced which can greatly decrease ballistic performance.

Figure 13:
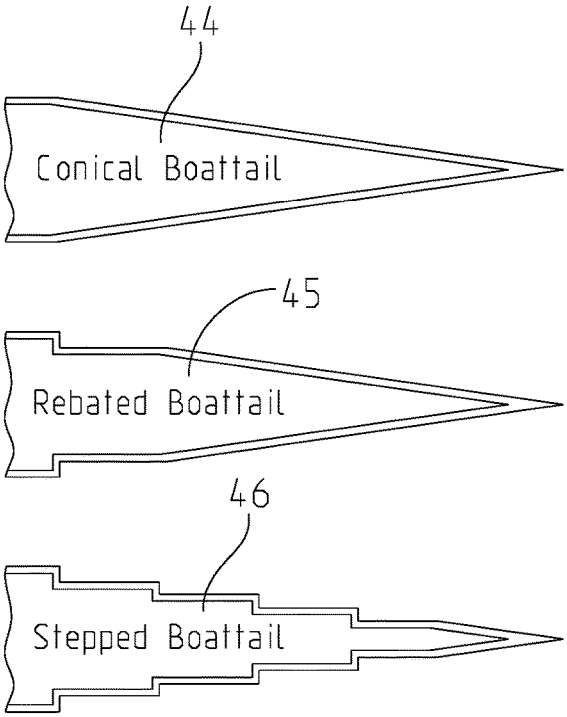
FIG. 13 shows different variations of boattails that can be used in different embodiments of an exemplary subsonic projectile.

In certain embodiments, a stepped boattail 46 can be used, as shown in FIG. 13, alongside a normal conical boattail 44 and the rebated boattail 45. The stepped boattail 46 which can help provide increased vertical surface area and reduce pressure drag. Laminar flow can separate from the profile and result in pressure drag. In addition, turbulent generators, such as grooves 48, can be added to prevent pressure drag. Turbulent generators can be included in a meplat or a rebated boattail.

Figure 14A:
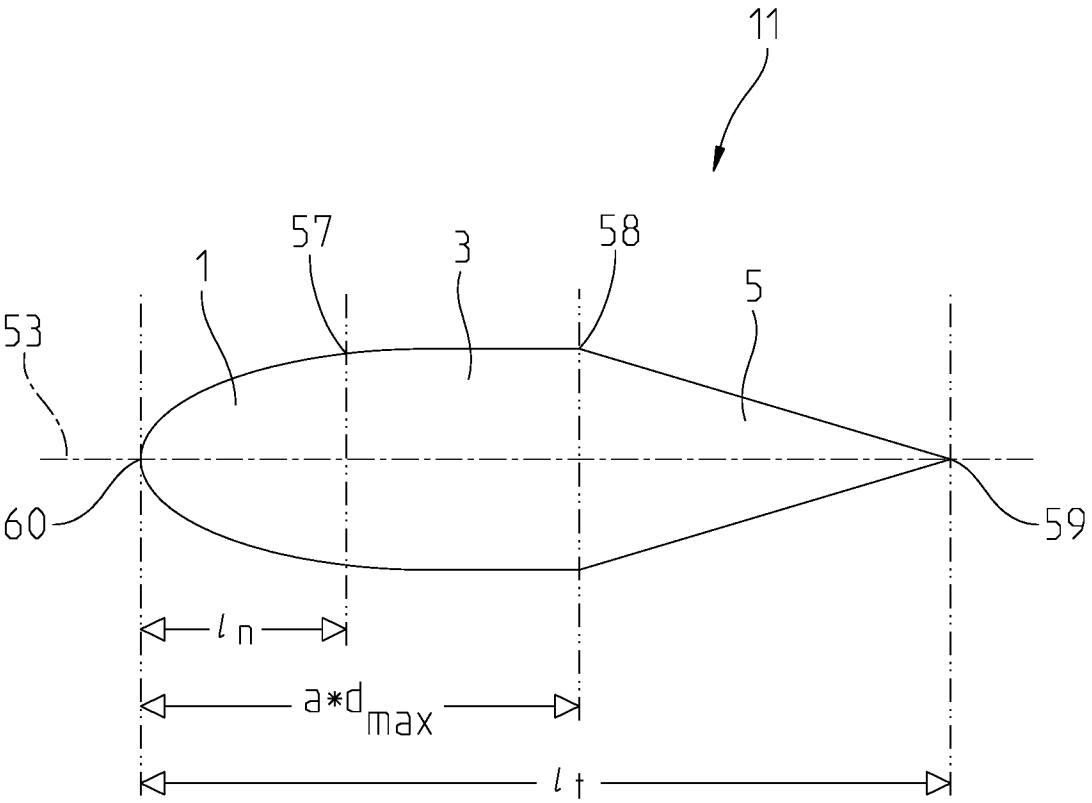
FIGS. 14*a* and 14*b* show a simplified exemplary diagram of a subsonic projectile in accordance with an exemplary embodiment of the invention.
Figure 14B:
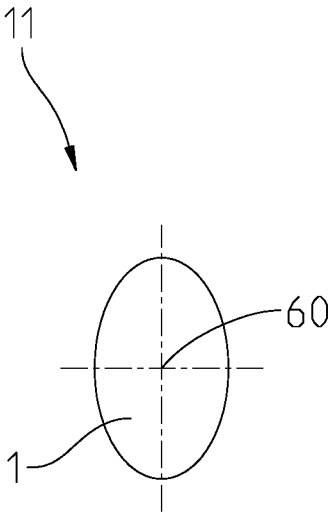

FIGS. 14*a* and 14*b* show another exemplary diagram of one embodiment of the invention as well as a set of equations that can inform a process of designing embodiments of the invention for different sizes. An embodiment of the projectile is shown having three sections: a nose cone 1, a body 3, and a boattail 5. A first central axis 53 runs through a terminal tip 60 of nose cone 1 through to a center an end of the boattail 5. Three points along the central axis 53 can be defined as a first transition point 57 between the nose cone 1 and the body 3, a second transition point 58 between the body 3 and the boattail 5, and a third point 59 at a terminal end of the boattail 5. Three distances, each between the terminal tip 60 of the nose cone 1 and one of the aforementioned points 57, 58, and 59 along the central axis 53 can be defined in the following manner. A first distance between the terminal tip 60 of the nose cone 1 and the first transition point 57 is named "$l_n$." This distance $l_n$ defines a distance along central axis 53 that the noise cone 1 occupies. A second distance between the terminal tip 60 of the nose cone 1 and the second transition point 58 is equal to "$a \cdot d_{max}$," wherein $d_{max}$ is a maximum allowed diameter of the projectile 11 and a is a length scalar. The length $a \cdot d_{max}$ minus the length $l_n$ defines a distance the body 3 occupies along the central axis 53. A third distance between the terminal tip 60 of the nose cone 1 and the third point 59 is named "$l_t$." The length $l_t$ minus the length $a \cdot d_{max}$ defines a distance along the central axis 53 that the boattail 5 occupies. Further mathematical proportions limit these values. A unit-less ratio value of $l_n/d_{max}$ must be greater than 1.0 but less than 100.00. Unit-less length scalar a must be greater than or equal to 0.0 but less than or equal to 100.0. A unit-less ratio of $l_t/d_{max}$ must be greater than or equal to 2.0 but less than or equal to 100.0. Moreover, angle θ must be greater than 0 degrees and less than or equal to 35 degrees.

A radius "r" of the projectile 11 at any given point x along the central axis 53, wherein the terminal tip 60 of the nose cone 1 is considered a value of 0 for x, can be calculated in the following manner. If x is greater than or equal to 0 but less than or equal to $l_n$, the radius r is expressed by equation 6:

$$r = \left(\frac{d_{max}}{2}\right)\sqrt{1 - \frac{x^2}{l_n}}$$

If x is greater than in but less than $(l_n + a \cdot d_{max})$ then the radius r is expressed by equation 7:

$$r = \frac{d_{max}}{2}$$

If x is greater than or equal to $(l_n + a \cdot d_{max})$ but less than or equal to it, then the radius r is expressed by equation 8:

$$r = (l_t - x)\tan\theta$$

Any number of grooves may be featured on the projectile 11. The grooves can have a plurality of possible profile shapes including a triangle-shaped cut and a square-shaped cut (as shown in FIG. 7). Points "p," located at a distance x at a radius r, and "q," located at another distance x at a radius r, define boundary edges of any given exemplary groove. A width "w" defines a distance between points p and q that is parallel to the central axis 53. A height "h" defines a height of the grooves in a direction starting from either point p or q and extending towards the central axis 53. The width w may be greater than or equal to 0 but less than or equal to $l_t$. The height h may be greater than or equal to 0 but less than or equal to r.

Figure 15B:
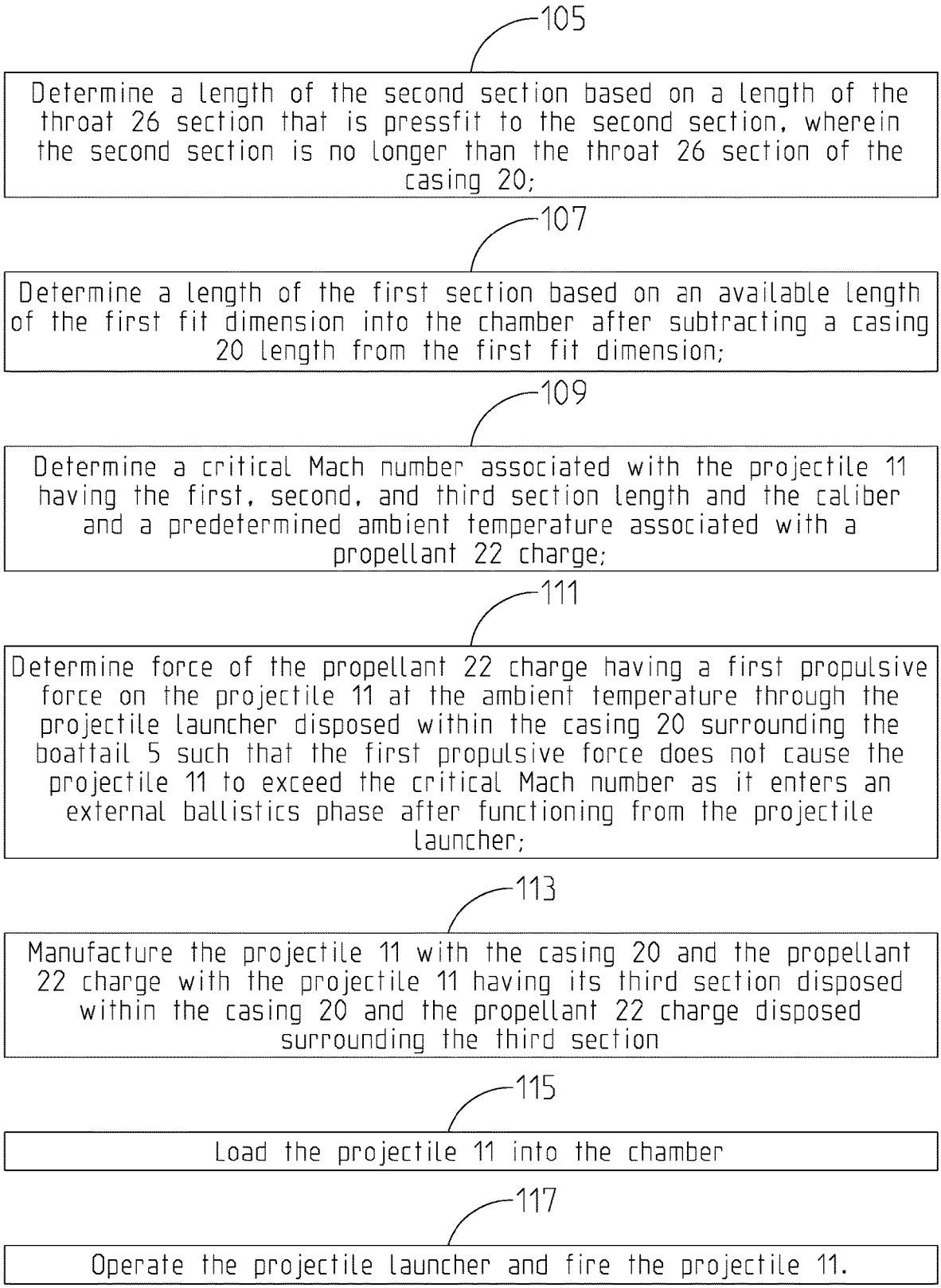

Referring to FIGS. 15*a* and 15*b*, a method associated with an embodiment of the invention is shown. At step 101, determine a caliber of the projectile 11 associated with a projectile launcher and casing 20 combination that will fit within a first fit dimension determined based on a chamber length of the projectile launcher and a non-interference fit diameter of a passage through a barrel of the projectile launcher, wherein the projectile 11 comprises a first, second, and third section, the first section is a nose cone 1 section, the second section is a body 3 section, and the third section is a boattail 5 section, wherein the casing 20 comprises a throat 26 area configured to receive and pressfit to a section of the second section and a primer 43 disposed on an opposing end of the casing 20 from the throat 26 area, the first section comprises an elliptical nose cone 1 shape, the second section comprises a cylindrical shape, and the third section is formed in a cone shape, wherein the third section is formed with a plurality of rebated 45 or stepped 46 structures, the first section is formed with a flat meplat 38 on a top of a center section of the first section, wherein the projectile 11 is formed with a second section to third section transition having an angle of eight degrees as defined by a first plane collinear with an external surface of the second section and a second plane collinear with an external surface of the third section, wherein the first, second, or third sections are formed with at least one turbulence generator comprising a ring or groove 48 structure formed into the first, second, or third sections that is perpendicular to a first axis formed by a line drawn from a center of the first section to a center of an end of the third section, wherein said projectile 11 is formed with a center of pressure aft of its center of gravity, wherein the projectile's 11 interior first section can be comprised of tungsten and the second section and third can be comprised of aluminum. At step 103, determine a length of a the third section based on an available area within said casing 20 defined as the boattail 5 length that runs in proximity to the throat 26 from a transition between the second and third sections to a location in proximity but not in contact with the primer 43. At step 105, determine a length of the second section based on a length of the throat 26 section that is pressfit to the second section, wherein the second section is no longer than the throat 26 section of the casing 20.

In FIG. 15*b*, at step 107, determine a length of the first section based on an available length of the fit into the chamber after subtracting the casing 20 length from the first fit dimension. At step 109, determine a critical Mach number associated with the projectile 11 having the first, second, and third section length and the caliber and a predetermined ambient temperature associated with a propellant 22 charge. At step 111, determine force of the propellant 22 charge having a first propulsive force on the projectile 11 at the ambient temperature through the projectile launcher disposed within the casing 20 surrounding the boattail 5 such that the propulsive force does not cause the projectile 11 to exceed the critical Mach number as it enters an external ballistics phase after functioning from the projectile launcher. At step 113, manufacture the projectile 11 with the casing 20 and the propellant 22 charge with the projectile 11 having its third section disposed within the casing 20 and the propellant 22 charge disposed surrounding the third section. At step 115, load the projectile 11 into the chamber; and at step 117, operate the projectile launcher and fire the projectile 11.

While various embodiments of an exemplary subsonic projectile could be extremely useful in military applications it can be beneficial in consumer markets. This can include use by varmint hunters wanting suppress sound created by their traditional supersonic firearm. This could also extend to larger game to allow for a potential follow up shot on a target.

Although the invention has been described in detail with reference to certain preferred embodiments, variations and modifications exist within the spirit and scope of the invention as described and defined in the following claims.

The invention claimed is:

1. A subsonic ammunition cartridge comprising:

a casing having a base end and an open end wherein said casing has an internal volume;

a primer inserted in said base end of said casing; and a projectile comprised of a nose cone, a body, and a boattail that gradually decreases in diameter toward an aft portion of said projectile, wherein said body is disposed between said nose cone and said boattail, wherein said boattail is disposed within said internal volume of said casing and a portion of said body in proximity to said boattail of said projectile is inserted in said open end of said casing and press fitted to said portion of the body such that said projectile is configured to exit from said open end of said casing through the air in a nose cone to boattail orientation at a subsonic velocity;

wherein said nose cone has a first length, said body has a second length, and said boattail has a third length, wherein said third length is at least 50% as long as said first and second lengths combined; and wherein said boattail is formed with at least one rebated structure comprising a right angle step from the body section of the projectile.

2. A subsonic ammunition projectile comprising:

a nose cone, a body, and a boattail that gradually decreases in diameter toward an aft portion of the projectile, wherein said body is disposed between said nose cone and said boattail, wherein said nose cone has a first length, said body has a second length, and said boattail has a third length, wherein said third length is at least 50% of said first and second lengths combined, wherein said boattail is formed with at least one rebated structure comprising a right angle step from the body section of the projectile;

wherein said projectile is configured to travel at a subsonic velocity in a direction of travel such that said nose cone is located at a front portion and said boattail is oriented at an aft with respect to said direction of travel.

3. The cartridge of claim 1, wherein at least one of said nose cone, said boattail, or said body are formed with at least one turbulence generator comprising a ring or groove structure formed into said nose, body, or boattail that is perpendicular to a first axis formed by a line drawn from a center of said nose cone to a center of said boattail.

4. The cartridge of claim 1, wherein said nose cone is formed into an elliptical shape with a flattened meplat on a center of said nose cone.

5. The cartridge of claim 1, wherein said projectile is formed with a center of pressure further from a center of said nose cone along a first axis than from a center of gravity.

6. The cartridge of claim 1, wherein said projectile is formed with a body to boattail transition having an angle of 8 degrees as defined by a first plane collinear with an external surface of said body and a second plane collinear with an external surface of said boattail.

7. The projectile of claim 2, wherein at least one of said nose cone, said boattail, or said body are formed with at least one turbulence generator comprising a ring or groove structure formed into said nose cone, body, or boattail that is perpendicular to a first axis formed by a line drawn from a center of said nose cone to a center of said boattail.

8. The projectile of claim 2, wherein said nose cone is formed into an elliptical shape with a flattened meplat on a center of said nose cone.

9. The projectile of claim 2, wherein said projectile is formed with a center of pressure further from a center of said nose cone along a first axis than a center of gravity.

10. The projectile of claim 2, wherein said projectile is formed with a body to boattail transition having an angle of 8 degrees as defined by a first plane collinear with an external surface of said body and a second plane collinear with an external surface of said boattail.

* * * * *